US011434739B2

(12) United States Patent
Guidry

(10) Patent No.: US 11,434,739 B2
(45) Date of Patent: Sep. 6, 2022

(54) FRACTURING SYSTEM WITH FLEXIBLE CONDUIT

(71) Applicant: Cameron International Corporation, Houston, TX (US)

(72) Inventor: Kirk P. Guidry, Cypress, TX (US)

(73) Assignee: Cameron International Corporation, Houston, TX (US)

( * ) Notice: Subject to any disclaimer, the term of this patent is extended or adjusted under 35 U.S.C. 154(b) by 0 days.

(21) Appl. No.: 17/378,913

(22) Filed: Jul. 19, 2021

(65) Prior Publication Data

US 2022/0003093 A1 Jan. 6, 2022

Related U.S. Application Data

(63) Continuation of application No. 16/862,390, filed on Apr. 29, 2020, now Pat. No. 11,066,913, which is a continuation-in-part of application No. 16/686,798, filed on Nov. 18, 2019, now abandoned, which is a continuation of application No. 15/492,251, filed on Apr. 20, 2017, now Pat. No. 10,480,300.

(60) Provisional application No. 62/330,188, filed on May 1, 2016.

(51) Int. Cl.
*E21B 43/26* (2006.01)

(52) U.S. Cl.
CPC ..... *E21B 43/26* (2013.01)

(58) Field of Classification Search
CPC .. F16L 33/01; F16L 11/15; F16L 27/11; F16L 25/0036; E21B 43/26
See application file for complete search history.

(56) References Cited

U.S. PATENT DOCUMENTS

| | | | |
|---|---|---|---|
| 1,051,046 | A | 1/1913 | Witzenmann |
| 1,329,760 | A | 2/1920 | Fulton |
| 1,615,536 | A | 1/1927 | Del Mar |
| 2,556,544 | A | 6/1951 | Johnson |
| 2,934,095 | A | 4/1960 | Lockhart |
| 3,118,691 | A | 1/1964 | Press |
| 3,233,668 | A | 2/1966 | Hamilton et al. |
| 3,306,637 | A | 2/1967 | Press et al. |
| 3,393,267 | A | 7/1968 | Busse |
| 3,508,768 | A | 4/1970 | Hogan |

(Continued)

FOREIGN PATENT DOCUMENTS

| | | | |
|---|---|---|---|
| CA | 2178856 | A1 | 12/1997 |
| EP | 1101997 | A1 | 5/2001 |

OTHER PUBLICATIONS

Texas Oil Tools: Well Intervention Equipment brochure, 2016, National Oilwell Varco, Houston, Texas, United States of America (15 pages).

(Continued)

*Primary Examiner* — Kipp C Wallace
(74) *Attorney, Agent, or Firm* — Eubanks PLLC

(57) ABSTRACT

A fracturing fluid delivery system is provided. In one embodiment, the system includes a fracturing manifold and a fracturing tree. A fluid conduit is coupled between the fracturing manifold and the fracturing tree to enable receipt of fracturing fluid by the fracturing tree from the fracturing manifold through the fluid conduit. The fluid conduit includes a flexible pipe segment between rigid ends of the fluid conduit. Additional systems, devices, and methods are also disclosed.

12 Claims, 11 Drawing Sheets

(56) References Cited

U.S. PATENT DOCUMENTS

| | | | |
|---|---|---|---|
| 3,581,775 | A | 6/1971 | Dahl |
| 3,934,902 | A | 1/1976 | McNamee |
| 3,993,100 | A | 11/1976 | Pollard et al. |
| 4,355,961 | A | 10/1982 | Riggs |
| 4,366,864 | A | 1/1983 | Gibson et al. |
| 4,383,554 | A | 5/1983 | Merriman |
| 4,385,018 | A | 5/1983 | Kutnyak |
| 4,405,016 | A | 9/1983 | Best |
| 4,437,691 | A | 3/1984 | Laney |
| 4,452,312 | A | 6/1984 | Roblin |
| 4,559,716 | A | 12/1985 | Daughtry et al. |
| 4,570,673 | A | 2/1986 | Kendrick et al. |
| 4,603,887 | A | 8/1986 | Mayfield et al. |
| 4,632,432 | A | 12/1986 | Reneau |
| 4,749,047 | A | 6/1988 | Taylor |
| 4,767,136 | A | 8/1988 | Lehmann |
| 4,805,430 | A | 2/1989 | Schmitz et al. |
| 4,998,756 | A | 3/1991 | Hart |
| 5,135,698 | A | 8/1992 | Salama et al. |
| 5,158,326 | A | 10/1992 | Anderson et al. |
| 5,195,589 | A | 3/1993 | Mota et al. |
| 5,244,045 | A | 9/1993 | Mota |
| 5,524,710 | A | 6/1996 | Shinn |
| 5,636,691 | A | 6/1997 | Hendrickson et al. |
| 5,927,344 | A | 7/1999 | Nobileau |
| 6,003,604 | A | 12/1999 | Wilkins |
| 6,004,639 | A | 12/1999 | Quigley et al. |
| 6,006,788 | A | 12/1999 | Jung et al. |
| 6,102,445 | A | 8/2000 | Thomas |
| 6,192,941 | B1 | 2/2001 | Mallen-Herrero et al. |
| 6,234,030 | B1 | 5/2001 | Butler |
| 6,364,024 | B1 | 4/2002 | Dallas |
| 6,609,734 | B1 | 8/2003 | Baugh |
| 6,691,743 | B2 | 2/2004 | Espinasse |
| 6,899,172 | B2 | 5/2005 | McLeod et al. |
| 7,481,239 | B2 | 1/2009 | McGuire et al. |
| 7,934,546 | B2 | 5/2011 | McGuire et al. |
| 8,100,182 | B2 | 1/2012 | Smith et al. |
| 8,110,741 | B2 | 2/2012 | Brotzell et al. |
| 8,241,453 | B2 | 8/2012 | Beteri et al. |
| 8,398,122 | B2 | 3/2013 | Crompton et al. |
| 8,528,585 | B2 | 9/2013 | McGuire |
| 8,770,277 | B2 | 7/2014 | Artherholt |
| 8,839,867 | B2 | 9/2014 | Conrad |
| 8,905,056 | B2 | 12/2014 | Kendrick |
| 8,960,307 | B2 | 2/2015 | Cain et al. |
| 8,978,763 | B2 | 3/2015 | Guidry |
| 9,068,450 | B2 | 6/2015 | Guidry |
| 9,175,556 | B2 | 11/2015 | Cherewyk et al. |
| 9,222,345 | B2 | 12/2015 | Conrad |
| 9,255,469 | B2 | 2/2016 | Conrad |
| 9,518,430 | B2 | 12/2016 | Guidry |
| 9,631,469 | B2 | 4/2017 | Guidry et al. |
| 9,670,745 | B1 | 6/2017 | Johansen et al. |
| 9,903,190 | B2 | 2/2018 | Conrad et al. |
| 9,915,132 | B2 | 3/2018 | Conrad |
| 9,932,800 | B2 | 4/2018 | Guidry |
| 10,094,195 | B2 | 10/2018 | Guidry |
| 10,132,146 | B2 | 11/2018 | Guidry |
| 10,323,475 | B2 | 6/2019 | Christopherson et al. |
| 10,385,643 | B2 | 8/2019 | Guidry |
| 10,385,645 | B2 | 8/2019 | Guidry |
| 10,385,662 | B2 | 8/2019 | Conrad |
| 10,400,538 | B2 | 9/2019 | Roesner |
| 10,443,763 | B2 | 10/2019 | Green et al. |
| 10,480,300 | B2 | 11/2019 | Guidry |
| 10,487,637 | B2 | 11/2019 | Guidry et al. |
| 11,066,913 | B2 | 7/2021 | Guidry et al. |
| 2003/0205378 | A1 | 11/2003 | Wellington et al. |
| 2003/0205385 | A1 | 11/2003 | Duhn et al. |
| 2004/0251020 | A1 | 12/2004 | Smith |
| 2006/0207763 | A1 | 9/2006 | Hofman |
| 2007/0125544 | A1 | 6/2007 | Robinson et al. |
| 2007/0227722 | A1 | 10/2007 | Atencio |
| 2008/0083539 | A1 | 4/2008 | Hickie |
| 2008/0277120 | A1 | 11/2008 | Hickie |
| 2009/0014184 | A1 | 1/2009 | Voss et al. |
| 2009/0090515 | A1 | 4/2009 | Chan et al. |
| 2009/0145597 | A1 | 6/2009 | Cherewyk |
| 2009/0261575 | A1 | 10/2009 | Bull et al. |
| 2010/0032031 | A1* | 2/2010 | Neal ..... E21B 21/02 166/381 |
| 2010/0051261 | A1 | 3/2010 | Koleilat et al. |
| 2010/0300672 | A1 | 12/2010 | Childress et al. |
| 2011/0030963 | A1 | 2/2011 | Demong et al. |
| 2011/0079399 | A1 | 4/2011 | Nguyen et al. |
| 2011/0108275 | A1 | 5/2011 | Borak et al. |
| 2011/0114320 | A1 | 5/2011 | Sponchia et al. |
| 2011/0132596 | A1 | 6/2011 | Yeh et al. |
| 2011/0259584 | A1 | 10/2011 | Broussard, II |
| 2012/0152564 | A1 | 6/2012 | Peltier |
| 2012/0155813 | A1 | 6/2012 | Quigley et al. |
| 2012/0181015 | A1 | 7/2012 | Kajaria et al. |
| 2012/0181016 | A1 | 7/2012 | Kajaria et al. |
| 2012/0181030 | A1 | 7/2012 | Kajaria et al. |
| 2012/0242081 | A1 | 9/2012 | Keays et al. |
| 2013/0284455 | A1 | 10/2013 | Kajaria et al. |
| 2014/0007970 | A1 | 1/2014 | Dodds |
| 2014/0238683 | A1 | 8/2014 | Korach et al. |
| 2015/0083426 | A1 | 3/2015 | Lesko et al. |
| 2015/0159458 | A1 | 6/2015 | Tan et al. |
| 2015/0211342 | A1 | 7/2015 | Shaw et al. |
| 2015/0275629 | A1 | 10/2015 | Hatton |
| 2015/0345272 | A1 | 12/2015 | Kajaria et al. |
| 2015/0354313 | A1 | 12/2015 | McClinton et al. |
| 2016/0186506 | A1 | 6/2016 | Sha et al. |
| 2016/0304170 | A1* | 10/2016 | Guffee ..... B63B 27/34 |
| 2016/0363242 | A1 | 12/2016 | De Nora |
| 2017/0175905 | A1 | 6/2017 | Martino et al. |
| 2018/0291718 | A1 | 10/2018 | Conrad et al. |
| 2020/0088021 | A1 | 3/2020 | Guidry |
| 2020/0131877 | A1 | 4/2020 | Guidry |
| 2020/0131889 | A1 | 4/2020 | Robinson et al. |
| 2021/0198953 | A1 | 7/2021 | Robinson et al. |
| 2021/0277740 | A1 | 9/2021 | Guidry |

OTHER PUBLICATIONS

Hydraulic Latch Assembly, webpage available at https://www.f-e-t.com/products/completions/well-intervention/pressure-control-equipment/hydraulic-latch-assembly on Jan. 19, 2019, Forum Energy Technologies, Houston, Texas, United States of America (4 pages).

* cited by examiner

FRACTURING SYSTEM WITH FLEXIBLE CONDUIT

BACKGROUND

This section is intended to introduce the reader to various aspects of art that may be related to various aspects of the presently described embodiments. This discussion is believed to be helpful in providing the reader with background information to facilitate a better understanding of the various aspects of the present embodiments. Accordingly, it should be understood that these statements are to be read in this light, and not as admissions of prior art.

In order to meet consumer and industrial demand for natural resources, companies often invest significant amounts of time and money in searching for and extracting oil, natural gas, and other subterranean resources from the earth. Particularly, once a desired subterranean resource is discovered, drilling and production systems are often employed to access and extract the resource. These systems may be located onshore or offshore depending on the location of a desired resource. Further, such systems generally include a wellhead assembly through which the resource is extracted. These wellhead assemblies may include a wide variety of components, such as various casings, valves, fluid conduits, and the like, that control drilling or extraction operations.

Additionally, such wellhead assemblies may use a fracturing tree and other components to facilitate a fracturing process and enhance production from a well. As will be appreciated, resources such as oil and natural gas are generally extracted from fissures or other cavities formed in various subterranean rock formations or strata. To facilitate extraction of such resources, a well may be subjected to a fracturing process that creates one or more man-made fractures in a rock formation. This facilitates, for example, coupling of pre-existing fissures and cavities, allowing oil, gas, or the like to flow into the wellbore. Such fracturing processes typically include injecting a fracturing fluid—which is often a mixture including sand and water—into the well to increase the well's pressure and form the man-made fractures. A fracturing manifold may provide fracturing fluid to one or more fracturing trees via fracturing lines (e.g., pipes). But the fracturing manifolds and associated fracturing trees are typically large and heavy and may be mounted to other equipment at a fixed location, making adjustments between the fracturing manifold and a fracturing tree difficult.

SUMMARY

Certain aspects of some embodiments disclosed herein are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below.

Some embodiments of the present disclosure generally relate to fracturing fluid delivery systems having flexible fracturing lines that bend to facilitate coupling of the lines between system components. The fracturing lines may include a flexible pipe body with a flexible liner that reduces erosive effects from fracturing fluid on the flexible pipe body. In one embodiment, a fracturing manifold is connected to a fracturing tree with a single, flexible fracturing fluid line.

Various refinements of the features noted above may exist in relation to various aspects of the present embodiments. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. Again, the brief summary presented above is intended only to familiarize the reader with certain aspects and contexts of some embodiments without limitation to the claimed subject matter.

BRIEF DESCRIPTION OF THE DRAWINGS

These and other features, aspects, and advantages of certain embodiments will become better understood when the following detailed description is read with reference to the accompanying drawings in which like characters represent like parts throughout the drawings, wherein.

DETAILED DESCRIPTION OF SPECIFIC EMBODIMENTS

Specific embodiments of the present disclosure are described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time-consuming, but would nevertheless be a routine undertaking of design, fabrication, and manufacture for those of ordinary skill having the benefit of this disclosure.

When introducing elements of various embodiments, the articles "a," "an," "the," and "said" are intended to mean that there are one or more of the elements. The terms "comprising," "including," and "having" are intended to be inclusive and mean that there may be additional elements other than the listed elements. Moreover, any use of "top," "bottom," "above," "below," other directional terms, and variations of these terms is made for convenience, but does not require any particular orientation of the components.

Figure 1:
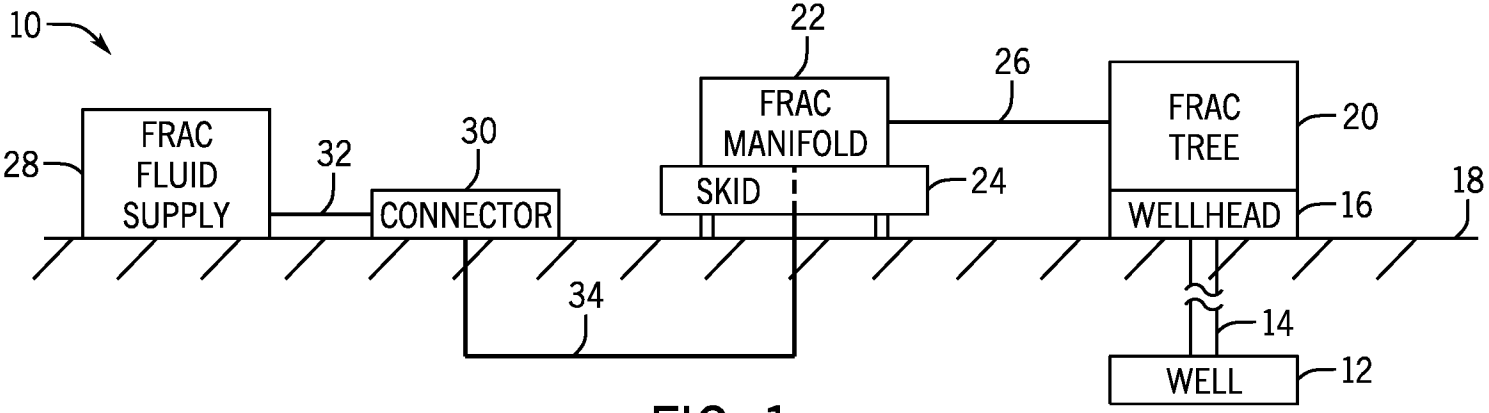
FIG. 1 generally depicts a fracturing system in accordance with an embodiment of the present disclosure.
Figure 2:
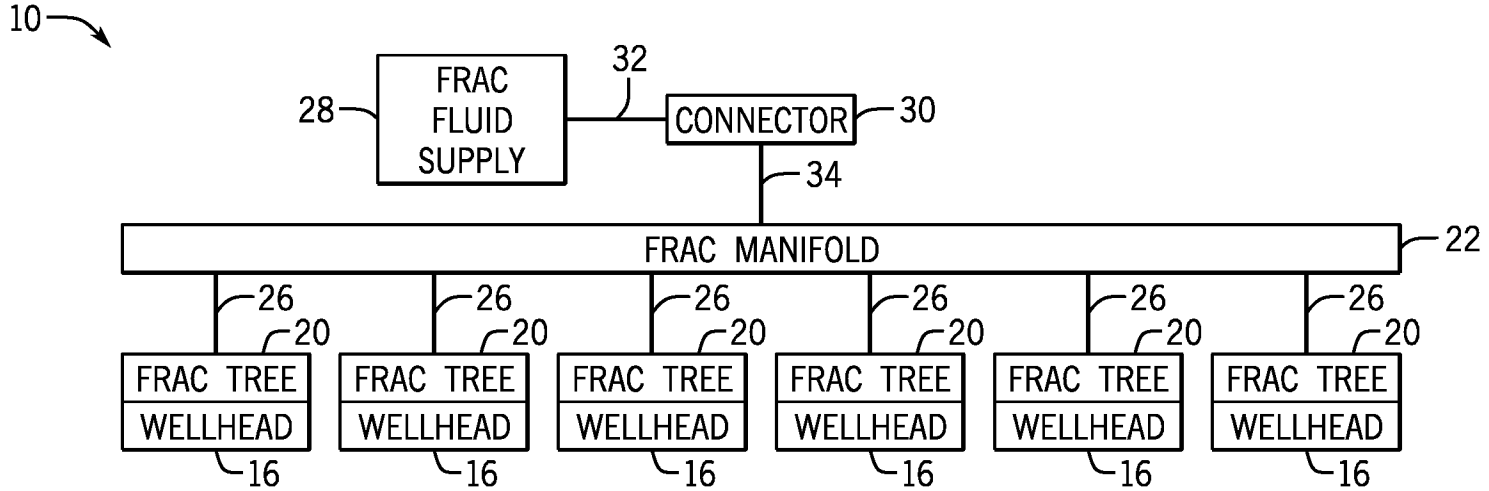
FIG. 2 is a diagram of the fracturing system of FIG. 1 with a fracturing manifold coupled to multiple fracturing trees in accordance with one embodiment.

Turning now to the present figures, an example of a fracturing system 10 is provided in FIGS. 1 and 2 in accordance with one embodiment. The fracturing system 10 facilitates extraction of natural resources, such as oil or natural gas, from a well 12 via a wellbore 14 and a wellhead 16. Particularly, by injecting a fracturing fluid into the well 12, the fracturing system 10 increases the number or size of fractures in a rock formation or strata to enhance recovery of natural resources present in the formation. In the presently illustrated embodiment, the well 12 is a surface well accessed by equipment of wellhead 16 installed at surface level (i.e., on ground 18). But it will be appreciated that natural resources may be extracted from other wells, such as platform or subsea wells.

The fracturing system 10 includes various components to control flow of a fracturing fluid into the well 12. For instance, the depicted fracturing system 10 includes a fracturing tree 20 and a fracturing manifold 22. The fracturing tree 20 includes at least one valve that controls flow of the fracturing fluid into the wellhead 16 and, subsequently, into the well 12. Similarly, the fracturing manifold 22 includes at least one valve that controls flow of the fracturing fluid to the fracturing tree 20 by a conduit or fluid connection 26, such as one or more pipes.

The fracturing manifold 22 is mounted on at least one skid 24 (e.g., a platform mounted on rails) to facilitate movement of the fracturing manifold 22 with respect to the ground 18. As depicted in FIG. 2, the fracturing manifold 22 is connected to provide fracturing fluid to multiple fracturing trees 20 and wellheads 16. But it is noted that the fracturing manifold 22 may instead be coupled to a single fracturing tree 20 in full accordance with the present techniques. In one embodiment in which the fracturing manifold 22 is coupled to multiple fracturing trees 20, various valves of the fracturing manifold 22 may be mounted on separate skids 24 to enable variation in the spacing between the valves.

Fracturing fluid from a supply 28 is provided to the fracturing manifold 22. In FIG. 1, a connector 30 receives fracturing fluid from the supply 28 through a conduit or fluid connection 32, such as pipes or hoses, and then transmits the fluid to the fracturing manifold 22 by way of a subterranean conduit or fluid connection 34. The fracturing fluid could be routed from the supply 28 to the fracturing manifold 22 entirely above ground without use of a subterranean conduit 34 in other instances. In one embodiment, the fracturing fluid supply 28 is provided by one or more trucks that deliver the fracturing fluid, connect to the connector 30, and pump the fluid into the fracturing manifold 22 via the connector 30 and connections 32 and 34. In another embodiment, the fracturing fluid supply 28 is in the form of a reservoir from which fluid may be pumped into the fracturing manifold 22. But any other suitable sources of fracturing fluid and manners for transmitting such fluid to the fracturing manifold may instead be used.

Figure 3:
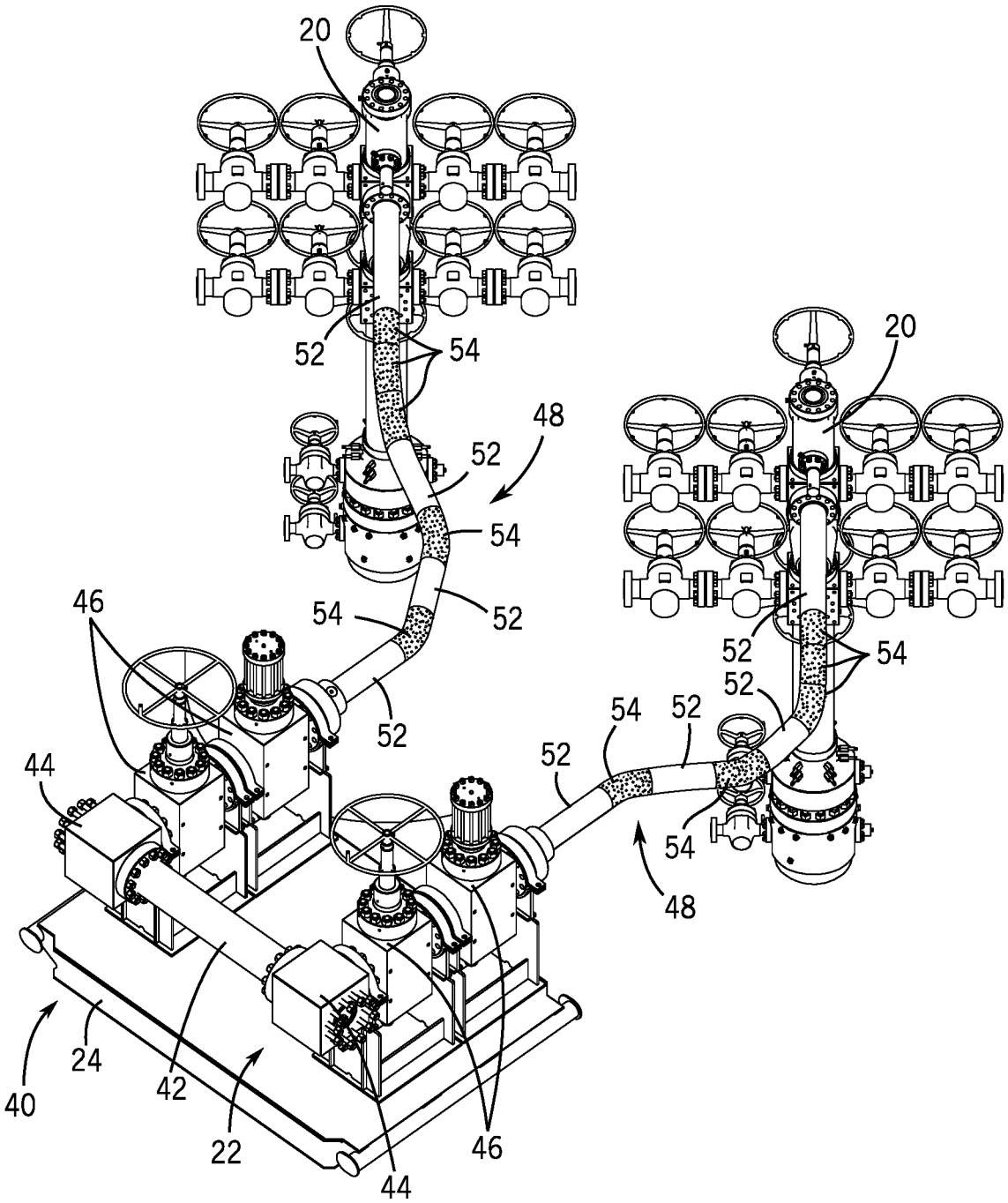
FIG. 3 is a perspective view of certain components of a fracturing system, including a portion of the fracturing manifold mounted on a skid and joined to fracturing trees with flexible fluid conduits, in accordance with an embodiment of the present disclosure.

In at least some embodiments, fluid conduits with flexible portions are coupled between the fracturing manifold 22 and fracturing trees 20 to facilitate assembly of a fracturing fluid delivery system. One such example is generally depicted in FIG. 3 as having a skid-mounted assembly 40 of the fracturing manifold 22 coupled to a pair of fracturing trees 20 by fluid conduits 48, which may also be referred to as fracturing lines 48. The assembly 40 includes a pipe 42 spanning connection blocks 44. The pipe 42 and the connection blocks 44 are part of a trunk line of the manifold 22 for routing fracturing fluid to be delivered to multiple fracturing trees, and it will be appreciated that other pipes or conduits can be coupled to the connection blocks 44 to join other portions of the trunk line (e.g., to other skid-mounted assemblies 40, which can be coupled to additional fracturing trees 20).

Valves 46 enable individual control of the flow of fracturing fluid from the trunk line to each fracturing tree 20 through the fluid conduits 48. The valves 46 are depicted here as mounted on the skid 24 as part of the assembly 40 of the fracturing manifold 22. In other instances, valves 46 could be positioned elsewhere (e.g., at the other end of the fluid conduits 48) or omitted (in which case valves of the fracturing trees could be used to control flow of fracturing fluid from the manifold into the wells).

Figure 4:
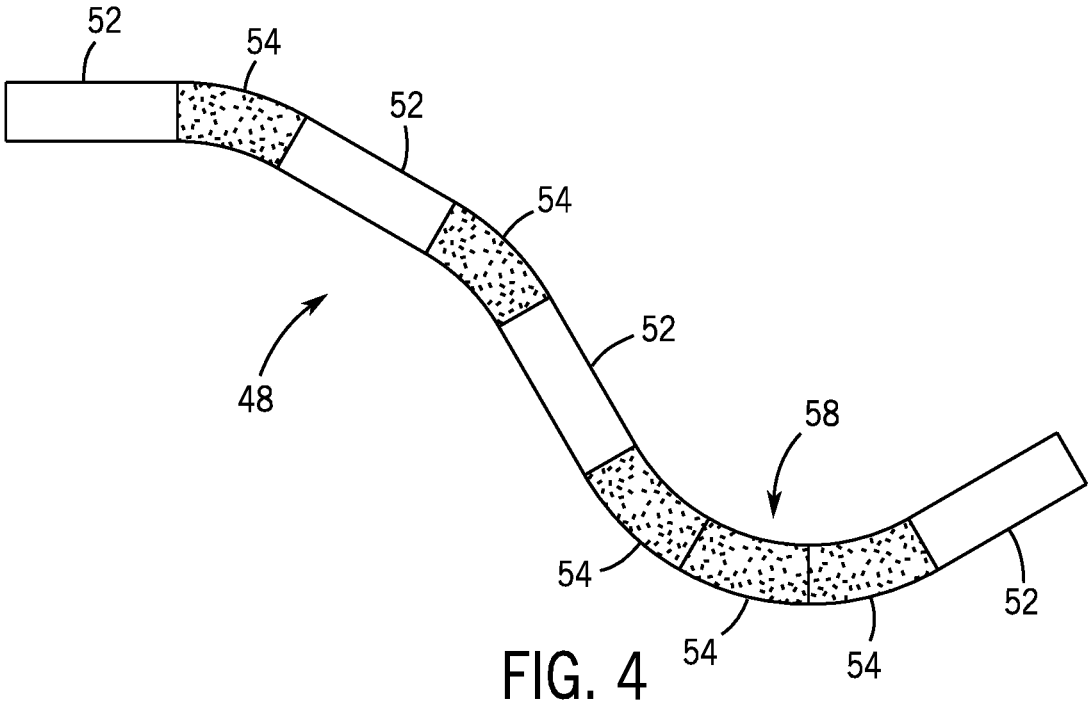
FIG. 4 depicts a flexible fluid conduit having a combination of rigid pipe segments and flexible pipe segments in accordance with one embodiment.

One example of a fluid conduit 48 for routing fluid between the fracturing manifold 22 and a fracturing tree 20 is depicted in FIG. 4. In this embodiment, the fluid conduit 48 includes a combination of rigid pipe segments 52 and flexible pipe segments 54. These pipe segments 52 and 54 can be formed of any suitable materials. In at least some instances, the rigid pipe segments 52 are steel pipes and the flexible pipe segments 54 are polymeric pipes, such as pipes including polyetheretherketone (PEEK) or another polymer in the polyaryletherketone (PAEK) family. The flexible pipe segments 54 may also or instead be provided as flexible composite pipes.

The inclusion of polymeric or composite materials in the flexible pipe segments 54 may reduce the weight of the conduit 48, as compared to a conduit formed entirely of steel. Further, the flexibility provided by such materials allows the conduit 48 to be bent at one or more of the flexible pipe segments 54 to allow an operator to more easily install the conduit 48 between the fracturing manifold 22 and a fracturing tree 20. For example, a flexible pipe segment 54 can be connected between two rigid pipe segments 52, such as shown in FIG. 4. In this arrangement, the flexible pipe segment 54 serves as a flexible joint, allowing the two rigid pipe segments 52 joined to the flexible pipe segment 54 to be positioned in different directions by bending the conduit 48 at the flexible joint. This, in turn, allows the distance between the ends of the conduit 48 to be varied during installation and facilitates connection of a conduit 48 of a given length between the fracturing manifold 22 and a fracturing tree 20. More particularly, this bending capability allows the profile of the conduit 48 to be changed to accommodate differences in spacing, elevation, and angular alignment between the manifold 22 and fracturing trees 20 in different installations. When connecting the fracturing manifold 22 to a fracturing tree 20 with a fluid conduit 48, the components of the fluid conduit 48 can be connected together and to the manifold 22 and the tree 20 in any suitable order.

In some cases, the bend radius of a flexible pipe segment 54 may be too high to provide a desired amount of bend in the conduit 48 along the length of the pipe segment 54. In such instances, multiple flexible pipe segments 54 can be connected to one another in series to allow additional bending of the conduit 48 along a given portion. One example of this is shown in FIG. 4, with a series 58 of flexible pipe segments 54 connected together between two rigid pipe segments 52.

Fracturing fluid typically contains sand or other abrasive particulates that can erode conduits through which the fracturing fluid flows. The rate of such erosion depends on many factors, but is generally greater at locations in which the direction of flow is changed, such as at elbows or bends in a conduit. As depicted in FIG. 4 and described above, the conduit 48 includes flexible pipe segments 54. While such flexible pipe segments 54 allow bending of the conduit 48 to facilitate its installation, this bending can make the flexible pipe segments 54 more susceptible to erosive wear in fracturing applications. In at least some embodiments, one or more of the flexible pipe segments 54 includes an interior liner (which may also be referred to as a wear sleeve) to reduce erosive effects from flow of fracturing fluid or other abrasive fluids through the conduit 48.

Figure 5:
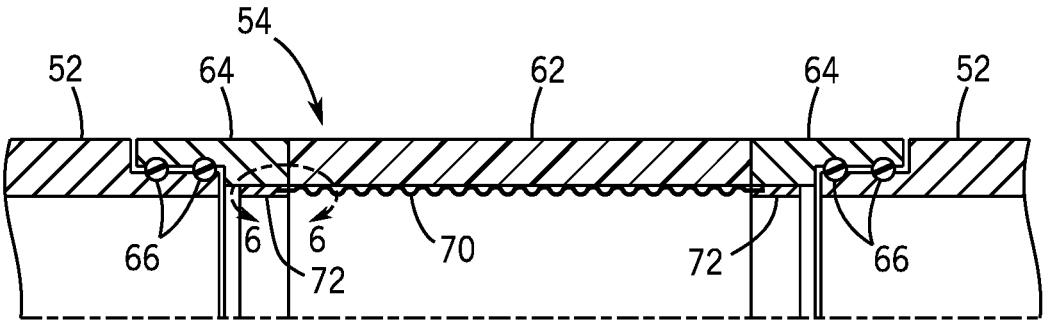
FIG. 5 is a partial cross-section of the fluid conduit of FIG. 4 and shows a flexible pipe segment having an outer pipe body and a corrugated liner in accordance with one embodiment.

A partial cross-section of the conduit 48 is depicted in FIG. 5 as having two rigid pipe segments 52 joined by a flexible pipe segment 54 having a liner. In this example, the flexible pipe segment 54 includes an outer pipe body 62 with connectors 64 at its ends. The outer pipe body 62 is a flexible body, and in at least some embodiments is provided as a polymeric body or a composite body (which may also include a polymer). The connectors 64, which are rigid steel connectors in certain embodiments, can be attached to the outer pipe body 62 in any suitable manner and facilitate connection of the outer pipe body 62 to the rigid pipe segments 52. Further, although particular connectors 64 are shown in FIG. 5 by way of example, any other connectors suitable for joining the outer pipe body 62 to the pipe segments 52 may instead be used. The coupling of the outer pipe body 62 to the pipe segments 52 should be fluid-tight to avoid leakage from the conduit 48 during use. This may be accomplished with discrete seals (e.g., seals 66 in FIG. 5) or in any other desired fashion.

The flexible pipe segment 54 also includes a liner 70 positioned within the outer pipe body 62. Various forms of an interior liner can be used to reduce erosion of the outer pipe body 62, but in FIG. 5 the liner 70 is depicted as a corrugated liner. In at least some embodiments, the corrugated liner is made of steel or some other metal. The liner 70 can have annular corrugations or be spiral-wound (with a helical corrugation pattern). In either case, the corrugations generally increase the flexibility of the liner 70 and reduce its bending radius as compared to a smooth liner made with the same material. The liner 70 and the outer pipe body 62 can bend to facilitate coupling of the conduit 48 between the fracturing manifold 22 and a fracturing tree 20, as described above.

Figure 6:
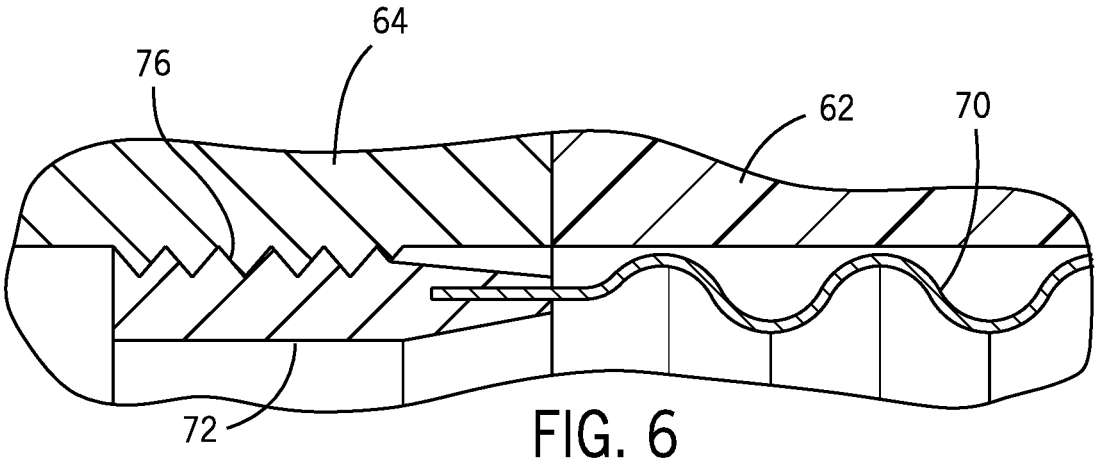
FIG. 6 is a detail view of a retaining ring for holding the corrugated liner of FIG. 5 within the outer pipe body in accordance with one embodiment.

During fluid flow through the conduit 48, the liner 70 reduces impingement of abrasive particulates on the inner surface of the outer pipe body 62 and, consequently, reduces erosive wear of the outer pipe body 62. The liner 70, however, may itself erode in the presence of abrasive flow. Accordingly, in some embodiments the liner 70 is a removable liner. For example, as depicted in FIG. 5, the liner 70 is retained within the outer pipe body 62 by retaining rings 72. These retaining rings 72 can be attached to the flexible pipe segment 54 in any desired manner, but are shown here as having threads 76 to allow the retaining rings 72 to be threaded to a mating, interior surface of the connectors 64. As generally illustrated in FIG. 6, the retaining rings 72 include tapered noses that receive ends of the liner 70 and hold the liner 70 within the outer pipe body 62. In some cases, the retaining rings 72 seal against the corrugated liner 70. Additionally, the routing of high-pressure fluid through the conduit 48 can create a differential between the interior and exterior pressures of the liner 70 and a radially outward force that causes the liner 70 to flatten against the inner surface of the outer pipe body 62.

Figure 7:
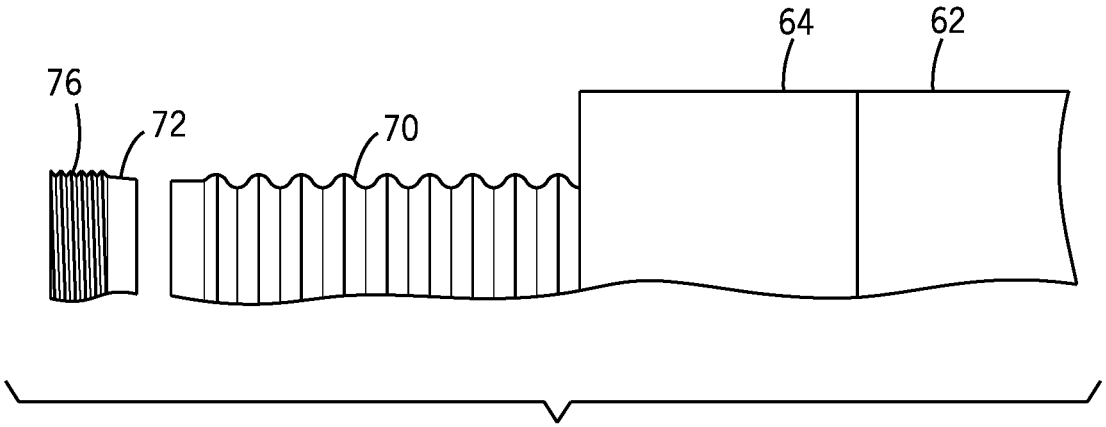
FIG. 7 is a partial exploded view of components of a flexible pipe segment and generally depicts removal of the retaining ring and corrugated liner of FIG. 6 from the outer pipe body.

After the conduit 48 is used to convey fracturing fluid, the conduit 48 can be disconnected from the fracturing manifold 22 and a fracturing tree 20. A flexible pipe segment 54 having the liner 70 can be disconnected from an adjoining rigid or flexible pipe segment, and the retaining ring 72 can be removed from the flexible pipe segment 54 (e.g., from the connector 64) to allow the liner 70 to be pulled from the outer pipe body 62, as generally shown in FIG. 7. A replacement liner 70 can then be installed in the outer pipe body 62 in place of the removed liner, allowing the non-liner portions of the flexible pipe segment 54 to be re-used in additional fracturing operations. That is, once the liner 70 is replaced, the flexible pipe segment 54 can again be connected as part of a conduit 48 coupled between a fracturing tree 20 and a fracturing manifold 22 (which may be the same fracturing manifold as previously used or a different fracturing manifold) for routing fracturing fluid between the tree and the manifold. The liner 70 can be replaced at any desired interval, such as after each use or after some other set number of uses, or can be replaced on an as-needed basis.

Figure 8:
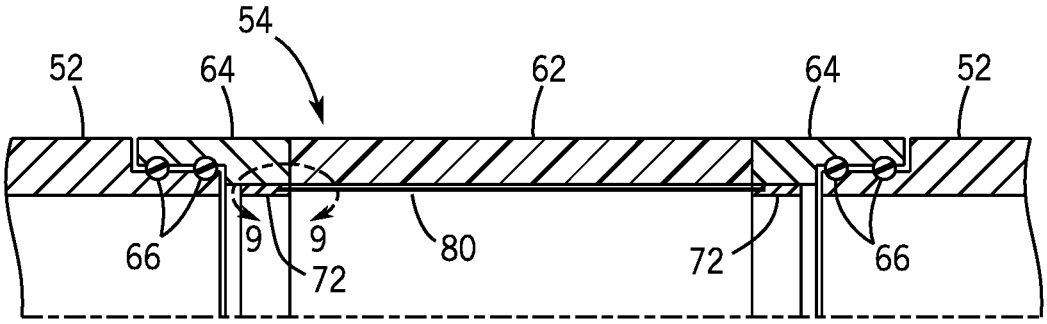
FIG. 8 is a partial cross-section of a flexible pipe segment similar to that of FIG. 5, but having a mesh liner instead of a corrugated liner, in accordance with one embodiment.
Figure 9:
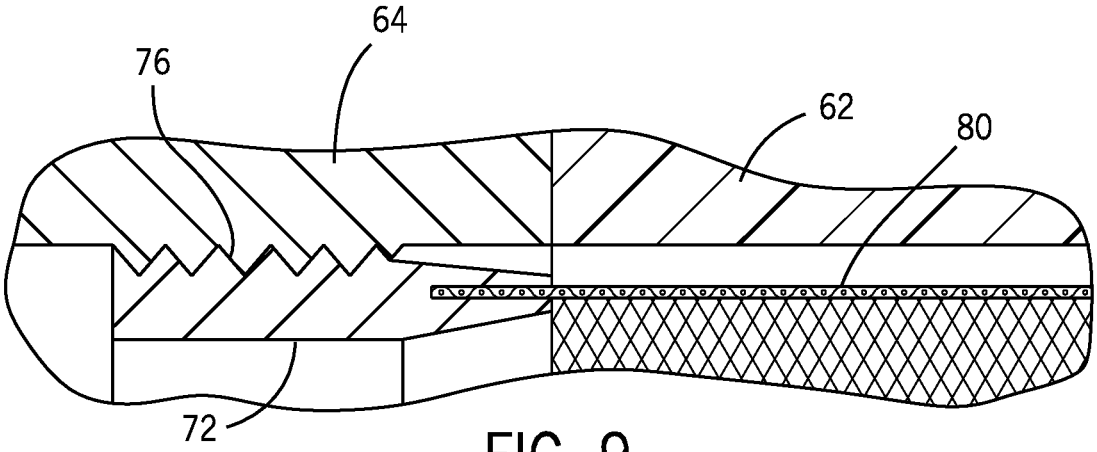
FIG. 9 is a detail view of a retaining ring and a portion of the mesh liner of FIG. 8 within the outer pipe body in accordance with one embodiment.

In another embodiment depicted in FIGS. 8 and 9, a flexible pipe segment 54 of the fluid conduit 48 includes a wire-mesh liner 80 (e.g., a steel wire-mesh liner) instead of the corrugated liner 70. The mesh liner 80 can be held in place within the outer pipe body 62 with retaining rings 72 (or in some other suitable manner) and reduces erosive wear of the outer pipe body 62 from fracturing fluid (or some other abrasive fluid) flowing through the conduit 48. The mesh liner 80 can be installed and replaced in a manner similar to that of the corrugated liner 70.

Figure 10:
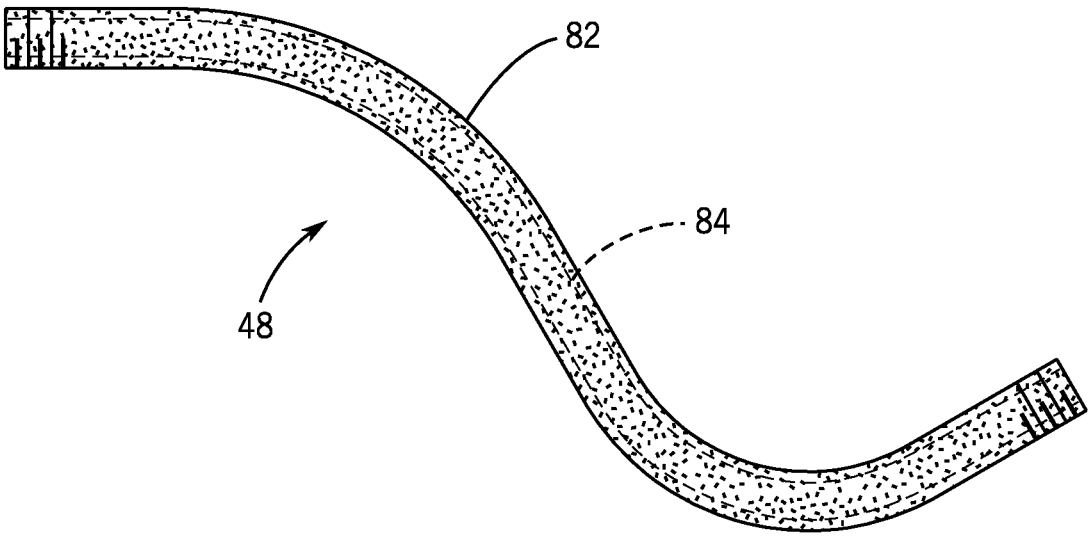
FIG. 10 depicts a flexible fluid conduit having a continuous, flexible pipe body, rather than a combination of rigid and flexible pipe segments, in accordance with one embodiment.

As described above, the fluid conduit 48 can include a combination of rigid pipe segments and flexible pipe segments coupled together to route fracturing fluid between the fracturing manifold 22 and a fracturing tree 20. But in some additional embodiments, rather than having flexible pipe segments that serve as flexible joints between rigid pipe segments and bend to facilitate installation, the conduit 48 is instead provided as a continuous flexible pipe that can be used to route fluid between the fracturing manifold 22 and a fracturing tree 20. One example of such a conduit 48 is generally depicted in FIG. 10 as having an outer pipe body 82 and a suitable liner 84, such as a corrugated liner, a mesh liner, or a smooth liner as described above. In some instances, the liner 84 is a removable liner that is retained within the outer pipe body 82 and can be replaced as desired. The outer pipe body 82 is depicted in FIG. 10 as having threaded ends, such as to facilitate coupling to connection flanges or directly to the manifold 22 and a tree 20, but the outer pipe body 82 can be connected between the manifold 22 and the tree 20 in any other suitable manner.

Figure 11:
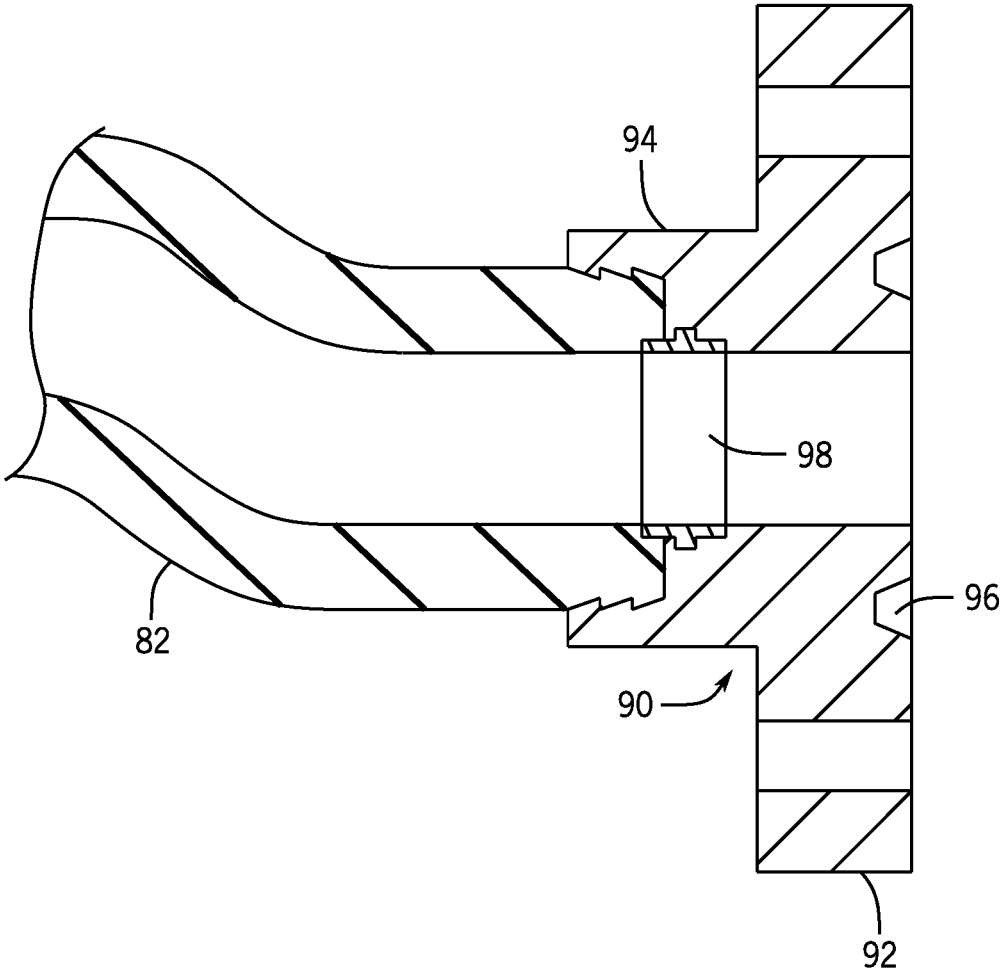
FIG. 11 is a cross-section of an end of a fracturing line having a flexible pipe body attached to a rigid connector in accordance with one embodiment.

The conduit 48 may also include rigid pipe connectors 90 joined to the ends of the flexible pipe body 82, such as depicted in FIG. 11 by way of example. The rigid pipe connectors 90, which may also be referred to as rigid end connectors, can be attached to the flexible pipe body 82 in any suitable manner. In the embodiment generally depicted in FIG. 11, for instance, an end of the flexible pipe body 82 is received within the neck 94 of a pipe connector 90. The flange 92 can be used to fasten the connector 90 to other equipment, such as the fracturing tree 20 or the fracturing manifold 22. In at least some embodiments, the flange 92 is an American Petroleum Institute (API) flange. In additional embodiments, the flange 92 may be omitted and the rigid pipe connectors 90 may connect to equipment in other suitable manners. The connector 90, which is formed of steel or another metal in some embodiments, can also include an annular seal groove 96 for receiving a gasket or other seal to facilitate a fluid-tight connection when the conduit 48 is fastened to other equipment. As presently shown, a forged ring 98 is used to help retain the end of the flexible pipe body 82 within the connector 90. During manufacture, for instance, a metal ring 98 having a diameter less than that of the bore of connector 90 can be positioned within the connector 90 near the end of the flexible pipe body 82 and then forged (e.g., by swaging) into the shape and position shown in FIG. 11 so as to overlap the end of the flexible pipe body 82 and an interior surface of the connector 90. A second connector 90 can be attached to the opposite end of the flexible pipe body 82 in a similar manner. In other embodiments, however, the flexible pipe body 82 can be attached to connectors 90 with epoxy or in some other manner without forging.

Figure 12:
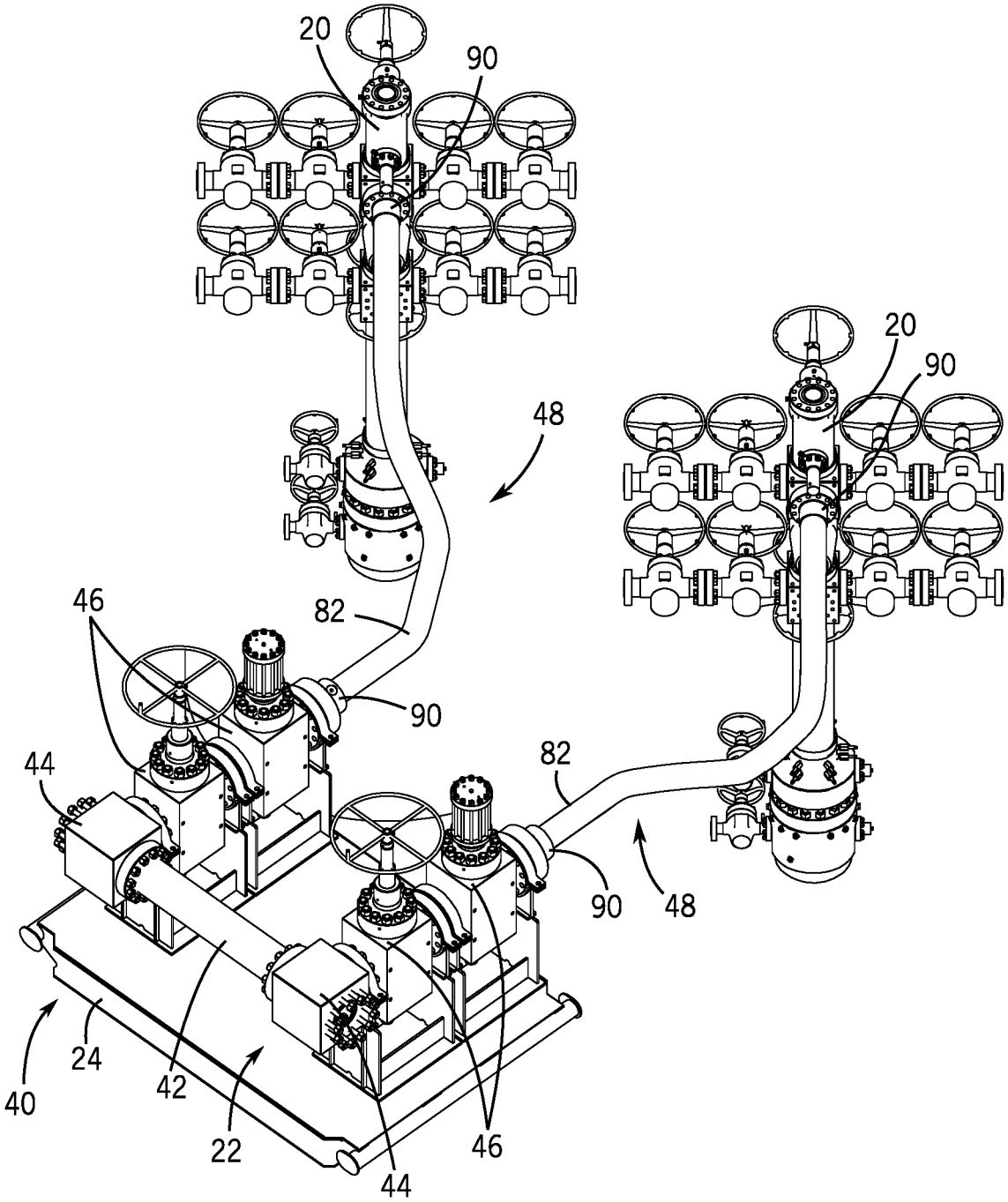
FIG. 12 is a perspective view of certain components of a fracturing system, including a portion of a fracturing manifold mounted on a skid and joined to fracturing trees with flexible fracturing lines with rigid ends, in accordance with one embodiment.

FIG. 12 depicts a skid-mounted assembly 40 of the fracturing manifold 22 coupled to a pair of fracturing trees 20 by fluid conduits 48 having flexible pipe bodies 82 and rigid pipe connectors 90. The rigid pipe connectors 90 may be attached to the ends of the flexible pipe bodies 82 in the manner shown in FIG. 11 or in any other suitable manner. The depicted apparatus also includes a pipe 42, connection blocks 44, and valves 46, such as described above.

Figure 13:
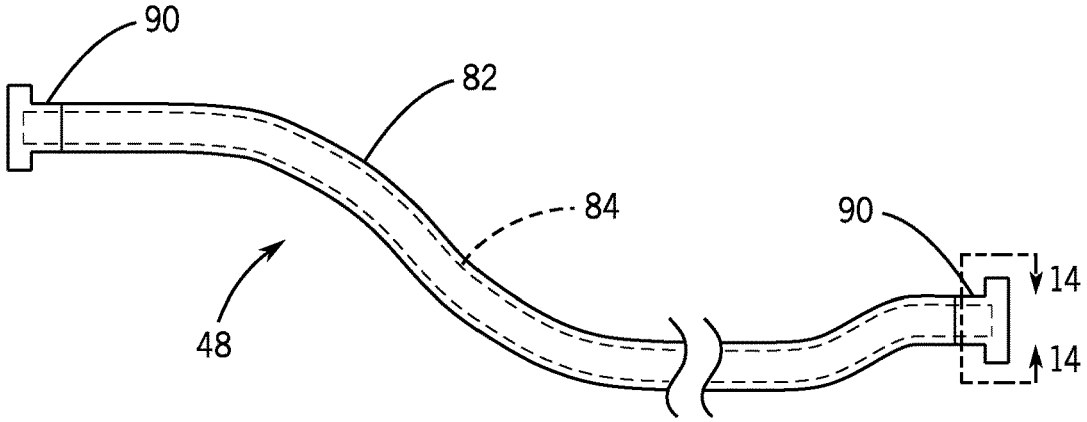
FIG. 13 generally depicts a fracturing line with a flexible pipe body, rigid ends, and a removable liner extending between the rigid ends in accordance with one embodiment.

As generally depicted in FIG. 13, each fluid conduit 48 of FIG. 12 may include a liner 84 that extends along an inner wall of the flexible pipe body 82 from one rigid end of the conduit 48 to the other rigid end (i.e., from the rigid pipe connector 90 at one end of the fluid conduit 48 to the other rigid pipe connector 90 at an opposite end of the fluid conduit 48). Although the liner 84 may take any of various forms (e.g., those described above), in some embodiments the liner 84 is a flexible polymeric liner, such as a natural or synthetic rubber liner, that isolates the inner wall of the flexible pipe body 82 from fracturing fluid routed through the conduit 48. And while such a liner 84 could be affixed to the inner wall of the flexible pipe body 82 (e.g., adhered to or formed integrally with the flexible pipe body 82), in some embodiments the liner 84 is a flexible polymeric liner that is affixed to one or both rigid pipe connectors 90 or to some other portion of the conduit 48 without being adhered to, formed integrally with, or otherwise affixed to the inner wall of the flexible pipe body 82. Although the liner 84 is shown in FIG. 13 extending continuously from the rigid pipe connector 90 at one end of the conduit 48 to the rigid pipe connector 90 at the other end of the conduit 48 to fully cover the inner wall of the flexible pipe body 82, the liner 84 could extend through less of the conduit 48 and cover less of the inner wall of the flexible pipe body 82 in other instances.

Figure 14:
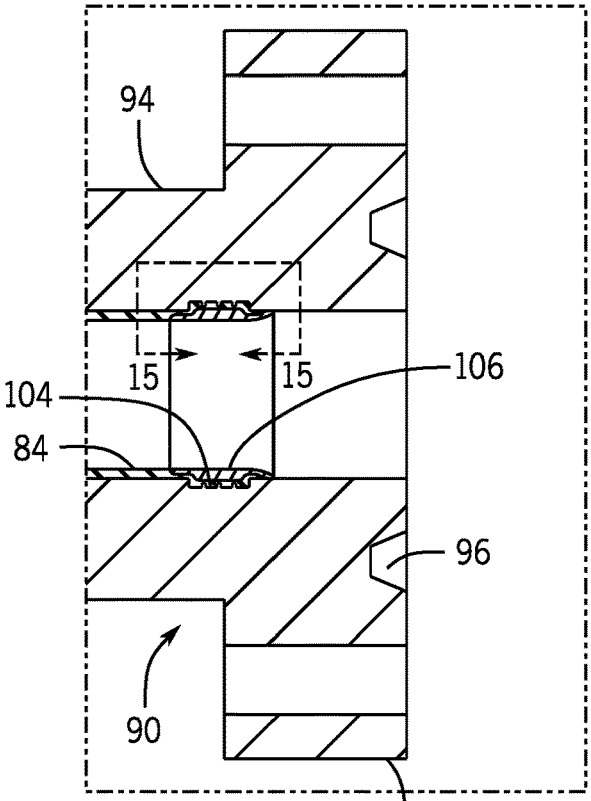
FIG. 14 is a cross-section showing the removable liner attached in a rigid end of the fracturing line with a ferrule in accordance with one embodiment.

The liner 84 may be secured within the conduit 48 in any suitable manner. The liner 84 may be fastened or adhered (e.g., with epoxy) to the rigid pipe connectors 90, for instance. In certain embodiments, an example of which is shown in FIG. 14, a flexible polymeric liner 84 is attached to a rigid pipe connector 90 with a ferrule 106. The ferrule 106 is depicted in FIG. 14 as a forged metal ring that has been radially expanded to compress and retain the flexible polymeric liner 84 against the rigid pipe connector 90. Although FIG. 14 shows just one end of the flexible polymeric liner 84 secured to the rigid pipe connector 90 on one end of the conduit 48 with a ferrule 106, it will be appreciated that the other end of the flexible polymeric liner 84 may also or instead be secured to a rigid pipe connector 90 of the other end of the conduit 48 in a similar fashion. In other embodiments, ferrules 106 may be used to secure flexible non-polymeric liners within conduits 48.

Figure 15:
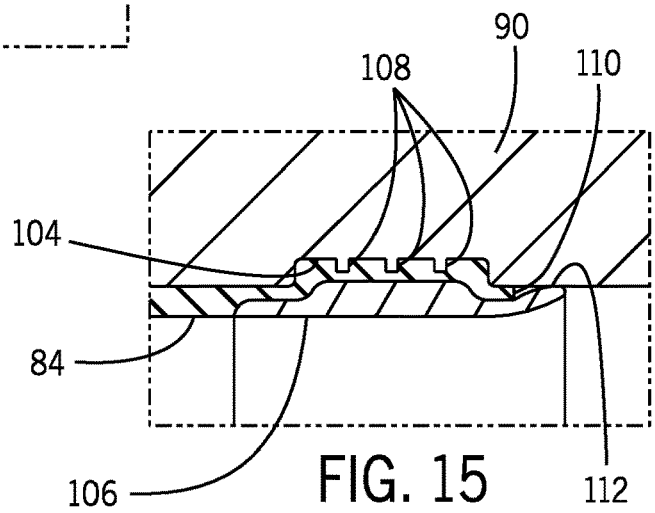
FIG. 15 is a detail view showing the ferrule of FIG. 14 compressing the flexible liner into a groove against retention nibs in accordance with one embodiment.

The rigid pipe connector 90 may include retention features to facilitate retention of the flexible polymeric liner 84 within the conduit 48. As shown in FIGS. 14 and 15, for instance, the rigid pipe connector 90 can include a groove 104 (e.g., a circumferential groove surrounding the liner 84) for receiving a portion of the flexible polymeric liner 84 and facilitating retention of the liner 84 within the conduit 48. When radially expanded into the position shown, the ferrule 106 holds a portion of the flexible polymeric liner 84 within the groove 104. In some instances, the groove 104 also includes retention nibs 108 that press into the liner 84 and facilitate retention. In some other instances, retention nibs 108 may be used without a groove 104. While several retention nibs 108 are depicted in FIGS. 14 and 15 for explanatory purposes, it will be appreciated that the rigid pipe connector 90 may include nibs 108 spaced circumferentially about the liner 84 to facilitate retention. The nibs 108 may have any suitable shape (e.g., with cylindrical, conical, or frustoconical ends) to facilitate retention of the liner 84. In other instances, teeth or other retention mechanisms may also or instead be used to engage and hold the liner 84 to the rigid pipe connector 90.

Additionally, one end of the ferrule 106 may contact the rigid pipe connector 90 to enclose an end 110 of the liner 84. In some embodiments, an end of the ferrule 106 is deformed (e.g., crimped outwardly) into contact with the rigid pipe connector 90 to form a seal 112 (e.g., a metal-to-metal seal) and prevent flow of fracturing fluid to an exterior surface of the liner 84 between the ferrule 106 and the bore wall of the rigid pipe connector 90. In some other embodiments, the liner 84 extends into the rigid pipe connector 90 beyond the ferrule 106 (e.g., the liner 84 may extend along the entire bore wall of the rigid pipe connector 90). The liner 84 may also or instead be adhered to the bore wall of the rigid pipe connector 90.

Flow of fracturing fluid through the conduit 48 of FIGS. 13-15 may cause wear of the flexible polymeric liner 84. Following use, the conduit 48 may be disconnected from fracturing equipment and inspected for signs of wear. In some instances, such as in the case of significant wear, the flexible polymeric liner 84 may be removed from the conduit 48 and replaced.

Figure 16:
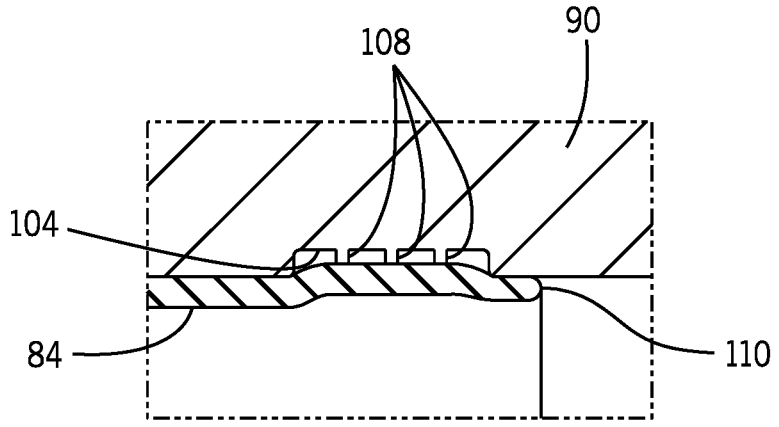
FIG. 16 is a detail view showing the flexible liner and groove of FIG. 15 after removal of the ferrule in accordance with one embodiment.
Figure 17:
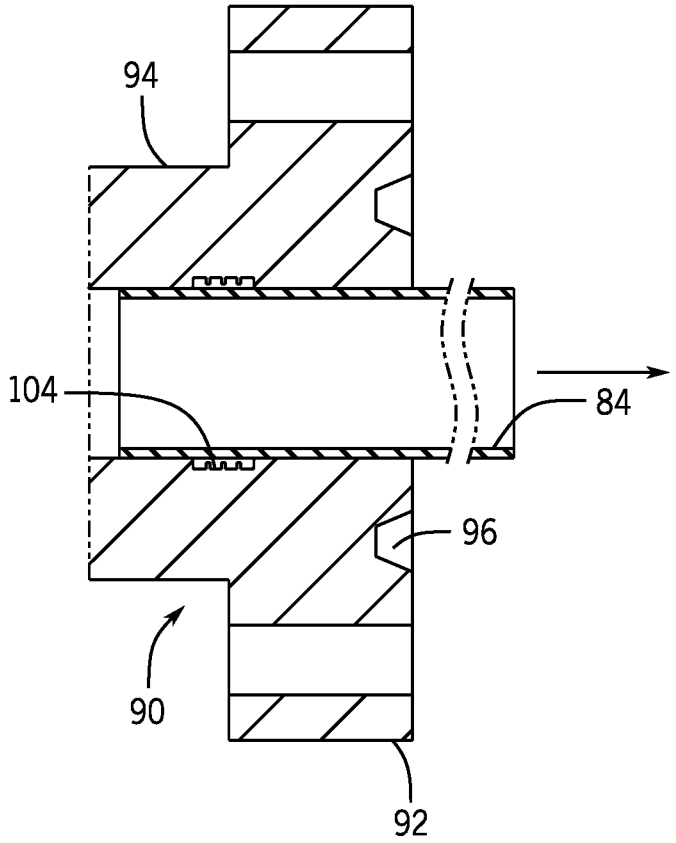
FIG. 17 generally depicts removal of the flexible liner from the fracturing line in accordance with one embodiment.

The flexible polymeric liner 84 may be removed from the conduit 48 in any suitable manner. In one embodiment, the ferrule 106 may be removed first to release the liner 84 from compression against the inner bore wall of the rigid pipe connector 90, as shown in FIG. 16. The ferrule 106 may be cut out of the conduit 48, may be removed with a pry bar, hook, or other tool, or may be removed in any other suitable fashion. The liner 84 may then be removed from the bore of the disconnected conduit 48, such as by pulling the liner 84 out through the end of the rigid pipe connector 90, as generally shown in FIG. 17. A replacement flexible polymeric liner 84 may then be inserted into and moved through the bore of the conduit 48 to be positioned in place of the previous liner 84 (i.e., extending along an inner wall of the flexible pipe body 82). The liner 84 may have an outer diameter slightly smaller than the inner diameters of the flexible pipe body 82 and of the rigid pipe connectors 90 to facilitate movement of the liner 84 into position within the bore.

Figure 18:
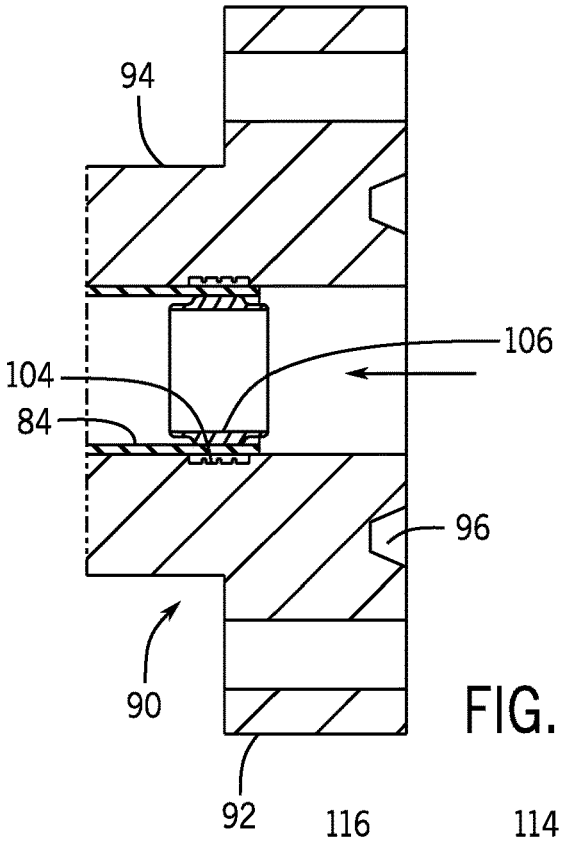
FIG. 18 generally depicts installation of a flexible liner in the fracturing line with a ferrule in accordance with one embodiment.

Ends of the replacement flexible polymeric liner 84 may be fastened to the rigid pipe connectors 90 with replacement ferrules 106 or in any other suitable fashion. As generally shown in FIG. 18, a ferrule 106 may be positioned in an end of the liner 84 within the conduit 48. The ferrule 106 may then be radially expanded to compress the liner 84 against the rigid pipe connector 90 to retain the liner 84 within the conduit 48. The ferrule 106 may take any suitable form but is shown in FIG. 18 as a metal ring.

In at least some embodiments, the ferrule 106 is radially expanded through one or more cold forging techniques. The ferrule 106 may be radially expanded with a hydraulic forging tool having radially movable dogs, for example. In other instances, the ferrule 106 may be radially expanded by driving a tapered mandrel through the bore of the ferrule 106 to stretch and radially expand the ferrule 106. Such a tapered mandrel may have a cylindrical portion with a diameter equal to the desired inner diameter of the forged ferrule 106 (e.g., as shown in FIG. 14) and may be tapered to a narrower end sized to fit within the bore of the ferrule 106 before forging (e.g., as shown in FIG. 18). The tapered mandrel may be driven into the bore of the ferrule 106 such that the increasing size of the mandrel, relative to the ferrule 106, drives the ferrule radially outward (e.g., into groove 104). The mandrel can include a second, larger tapered portion on an opposite side of the above-noted cylindrical portion (i.e., the second tapered portion further from the narrower end than the above-noted cylindrical portion and wider than that cylindrical portion) to crimp the end of the ferrule 106 and form the seal 112. While installation of a replacement liner 84 within the conduit 48 is described above, it will be appreciated that the original liner 84 could be installed in the conduit 48 in the same manner.

Figure 19:
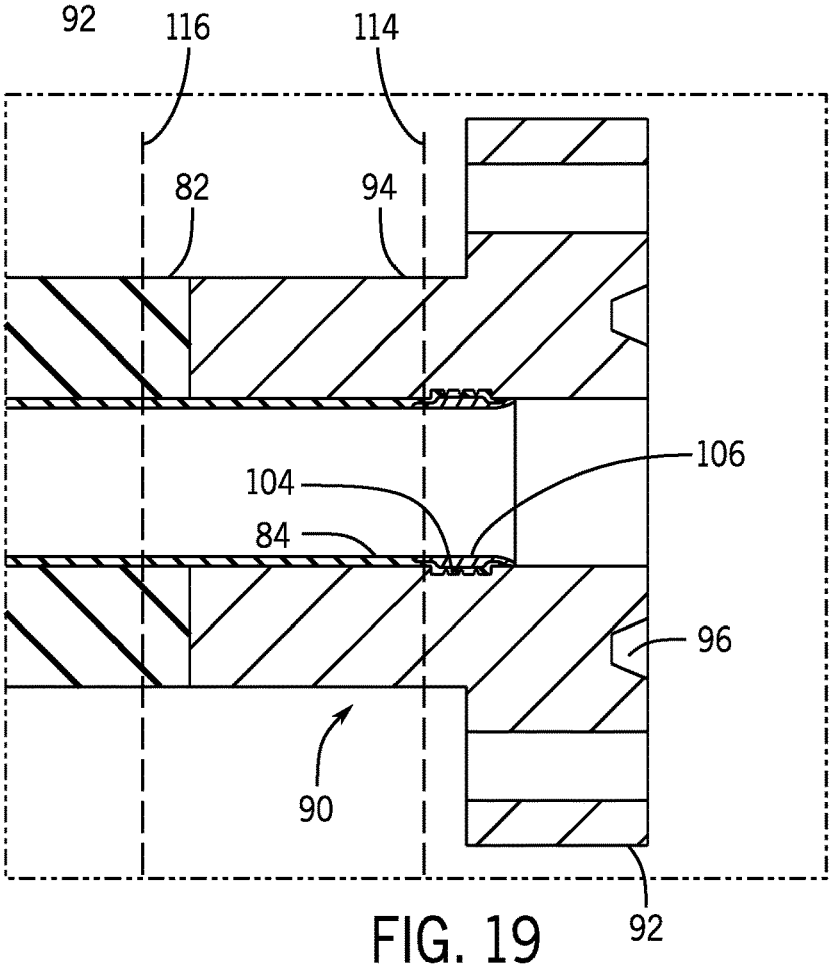
FIG. 19 shows the flexible liner installed in the fracturing line with the ferrule in accordance with one embodiment.

In some instances, the ferrule 106 and the liner 84 may be removed through the end of the conduit 48 without separating the rigid pipe connector 90 from the flexible pipe body 82. In other cases, however, the conduit 48 may be cut to facilitate removal of the liner 84 from the bore of the conduit 48. In one embodiment, for instance, the conduit 48 may be cut across the rigid pipe connector 90 and the liner 84, such as along line 114 in FIG. 19. By separating a portion of the rigid pipe connector 90 having at least some of the ferrule 106 and radially compressed portion of the liner 84, the liner 84 may be more easily removed from the conduit 48, such as by pulling the liner 84 out of the flexible pipe body 82 through the severed end of the rigid pipe connector 90. After removal of the liner 84, the severed portion of the rigid pipe connector 90 (or a suitable replacement portion) could be reattached (e.g., through welding) to the conduit 48 for further use. In another embodiment, the conduit 48 may be cut across the flexible pipe body 82 and the liner 84, such as along line 116 at an end of the flexible pipe body 82 in FIG. 19, to allow the liner 84 to be removed through the severed end of the flexible pipe body 82. Following removal of the liner 84, a rigid pipe connector 90 may be attached to the severed end of the flexible pipe body 82 in any suitable manner, a new liner 84 could be installed, and the conduit 48 may be used again to convey fracturing fluid. While a single end of the conduit 48 is depicted in FIG. 19, it will be appreciated that similar techniques may be used at the other end of the conduit 48 to facilitate removal of a liner 84 that is attached to a rigid pipe connector 90 at each end of the conduit 48.

Figure 21:
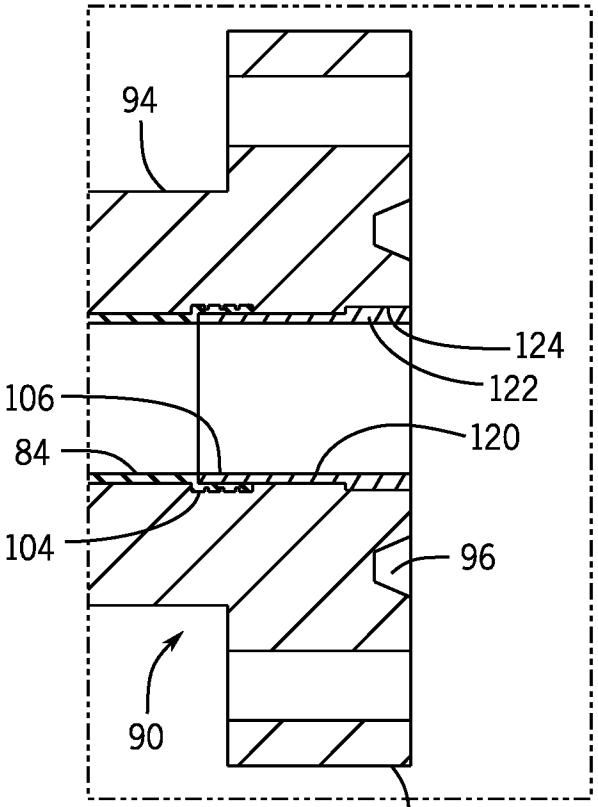
FIGS. 20 and 21 generally depict a sacrificial sleeve in a rigid end of the fracturing line, in which the sacrificial sleeve embodies a ferrule for attaching the flexible liner to the rigid end, in accordance with one embodiment.
Figure 20:
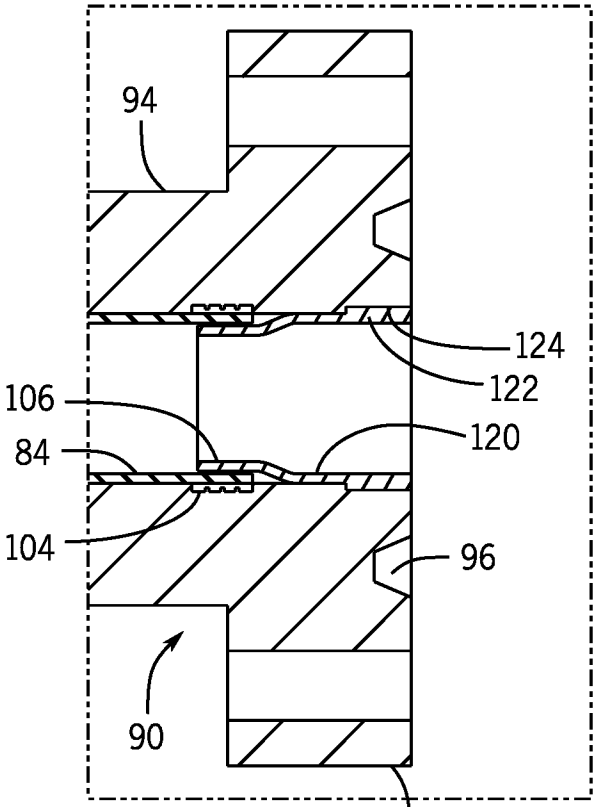

In some embodiments, a sacrificial sleeve may be installed in a rigid pipe connector 90. As shown in FIGS. 20 and 21, for instance, a sacrificial sleeve 120 is installed in a rigid pipe connector 90 and extends along an interior bore wall of the rigid pipe connector 90 to reduce erosive wear of the interior bore wall during flow operations (e.g., during fracturing through the conduit 48). In some embodiments, the sacrificial sleeve 120 is a metal sleeve that includes the ferrule 106. That is, the end of the sleeve 120 may be used as a ferrule to facilitate retention of the liner 84 within the rigid pipe connector 90, as described above. As depicted in FIG. 20, during installation the sleeve 120 may have a narrower end embodying the ferrule 106 that is received within an end of the liner 84. The other end of the sleeve 120 may include an enlarged diameter portion (i.e., a head 122) that is received in a socket 124 of the rigid pipe connector 90. With the sleeve 120 positioned as shown in FIG. 20, the ferrule 106 portion of the sleeve 120 may be expanded radially outward to the position shown in FIG. 21 to compress a portion of the liner 84 between the ferrule 106 and the inner wall of the rigid pipe connector 90. The ferrule 106 may be radially expanded in any suitable manner, such as with a hydraulic forging tool or a tapered mandrel driven through the sleeve 120 to deform the ferrule 106 from the position shown in FIG. 20 to the position shown in FIG. 21. While one rigid pipe connector 90 and sleeve 120 are shown in FIGS. 20 and 21, a conduit 48 may include a rigid pipe connector 90 and a sleeve 120 at each end of the conduit 48.

The conduits 48 and the fracturing fluid delivery systems described above can be constructed for various operating pressures and with different bore sizes depending on the intended application. In some embodiments, the fluid conduits 48 are constructed for rated maximum operating pressures of 10-15 ksi (approximately 69-103 MPa). Further, the conduits 48 of some embodiments have bores between four and eight inches (approx. 10 and 20 cm) in diameter, such as a five-and-one-eighth-inch (approx. 13 cm) diameter or a seven-inch (approx. 18 cm) diameter. Additionally, while certain examples are described above regarding the use of conduits 48 for transmitting fluid to a wellhead assembly, the conduits 48 could also be used in other instances to convey fluids between other components, such as to or between portions of the fracturing manifold 22.

While the aspects of the present disclosure may be susceptible to various modifications and alternative forms, specific embodiments have been shown by way of example in the drawings and have been described in detail herein. But it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A fracturing system comprising:

a fracturing manifold;

a fracturing tree; and a fluid conduit coupled between the fracturing manifold and the fracturing tree to enable receipt of fracturing fluid by the fracturing tree from the fracturing manifold through the fluid conduit, wherein the fluid conduit includes a first rigid pipe segment at a first end of the fluid conduit, a second rigid pipe segment at a second end of the fluid conduit opposite the first end, and at least one flexible pipe segment between the first rigid pipe segment and the second rigid pipe segment, and wherein the first rigid pipe segment is connected to receive fracturing fluid from the fracturing manifold, the at least one flexible pipe segment is positioned to convey the received fracturing fluid between the first rigid pipe segment and the second rigid pipe segment, the second rigid pipe segment is connected to output the received fracturing fluid toward the fracturing tree, the fluid conduit has a bore diameter between four and eight inches, the fluid conduit is constructed to flow fracturing fluid at 10-15 ksi operating pressure, and the at least one flexible pipe segment includes a flexible polymeric outer pipe body and a flexible wear liner within the flexible polymeric outer pipe body to reduce erosion of the flexible polymeric outer pipe body from flow of the received fracturing fluid through the at least one flexible pipe segment.

2. The fracturing system of claim 1, wherein the flexible wear liner is a corrugated liner positioned within the flexible polymeric outer pipe body.

3. The fracturing system of claim 1, wherein the flexible wear liner is a wire-mesh liner positioned within the flexible polymeric outer pipe body.

4. The fracturing system of claim 1, wherein the flexible wear liner positioned within the flexible polymeric outer pipe body is a removable liner.

5. The fracturing system of claim 4, comprising a retaining ring attached to an interior surface of the at least one flexible pipe segment so as to retain the removable liner within the flexible polymeric outer pipe body.

6. The fracturing system of claim 5, wherein the at least one flexible pipe segment includes a rigid connector to facilitate connection of the at least one flexible pipe segment to another pipe segment via the rigid connector, and the retaining ring is threaded to the rigid connector of the at least one flexible pipe segment.

7. The fracturing system of claim 1, wherein the at least one flexible pipe segment includes a flexible pipe segment having rigid connectors at its ends to facilitate connection of the flexible pipe segment to other pipe segments via the rigid connectors.

8. The fracturing system of claim 1, wherein the at least one flexible pipe segment includes two flexible pipe segments joined to one another.

9. The fracturing system of claim 1, wherein the at least one flexible pipe segment includes a flexible composite pipe segment.

10. The fracturing system of claim 1, wherein the flexible wear liner is a smooth liner within the flexible polymeric outer pipe body.

11. A method comprising:

coupling a fluid conduit having an outer body to one of a fracturing manifold or a fracturing tree, wherein the outer body includes a first rigid pipe at one end of the outer body, a second rigid pipe at an opposite end of the outer body, and a flexible polymeric pipe between the first rigid pipe and the second rigid pipe, and wherein the fluid conduit has a bore diameter between four and eight inches, and the fluid conduit includes a flexible wear liner within the flexible polymeric pipe to protect an interior surface of the outer body from erosive wear from flow of fracturing fluid through the fluid conduit;

bending the outer body and the flexible wear liner at a flexible portion of the flexible polymeric pipe to facilitate alignment of the fluid conduit between the fracturing manifold and the fracturing tree; and coupling the fluid conduit to the other of the fracturing manifold or the fracturing tree;

wherein the fluid conduit completes a fluid connection between the fracturing manifold and the fracturing tree so that fracturing fluid at 10-15 ksi operating pressure can be routed between the fracturing manifold and the fracturing tree through the fluid conduit to fracture a well.

12. The method of claim 11, comprising routing fracturing fluid between the fracturing manifold and the fracturing tree through the fluid conduit.

* * * * *